US005918659A

United States Patent [19]

Lee

[11] Patent Number: 5,918,659

[45] Date of Patent: Jul. 6, 1999

[54] LENGTH-ADJUSTABLE COLLAPSIBLE DOORPLATE ASSEMBLY

[76] Inventor: Chen Hsiang Lee, Suite 1, No. 10, Lane 73, Chung-Chien Road, Hsiao-Kang, Kaohsiung, Taiwan

[21] Appl. No.: 09/102,666

[22] Filed: Feb. 23, 1998

[30] Foreign Application Priority Data

Jul. 31, 1997 [TW] Taiwan ..... 86212970

[51] Int. Cl.[6] ..... E05D 15/26

[52] U.S. Cl. ..... 160/199; 49/505

[58] Field of Search ..... 160/199, 201, 160/206, 213, 197, 200, 202, 203, 205, 211, 214, 113, 118, 181; 49/505; 16/235, 239

[56] References Cited

U.S. PATENT DOCUMENTS 3,799,237 3/1974 Proserpi ..... 160/199
4,276,919 7/1981 Walters ..... 160/199 X
4,497,357 2/1985 Labelle ..... 160/199
4,534,395 8/1985 Carroll ..... 160/199

*Primary Examiner*—David M. Purol
*Attorney, Agent, or Firm*—Rosenberg, Klein & Bilker

[57] ABSTRACT

A collapsible doorplate assembly includes a fixing member secured to a wall, a length-adjustable connecting device having a first end securely connected to the fixing member and a second end, a number of pivotal connecting members, and a number of leaf plates. Each two adjacent leaf plates are pivotally connected by one of the pivotal connecting members. An innermost one of the pivotal connecting members, which is nearest to the fixing member, is connected between the length-adjustable connecting device and an innermost one of the leaf plates which is nearest to the fixing member. The length-adjustable connecting arrangement includes an engaging member and a movable member. The engaging member includes a first end securely engaged with the fixing member and a second end. The movable member includes a first end slidably engaged with the second end of the engaging member and a second end in pivotal connection with the innermost pivotal connecting member.

2 Claims, 5 Drawing Sheets

LENGTH-ADJUSTABLE COLLAPSIBLE DOORPLATE ASSEMBLY

BACKGROUND OF THE INVENTION

1. Field of the Invention

The present invention relates to a collapsible doorplate assembly that is adjustable in an overall length thereof after installation.

2. Description of the Related Art

FIGS. 5 and 6 illustrate a conventional collapsible doorplate assembly which includes a fixing member 50, a connecting member 60 having a fastener 61 formed on a first end thereof for connection with a snapping fastener 51 of the fixing member 50, and a pivotal connecting member 70 having two chambers 71 respectively defined in two sides thereof for respectively, pivotally engaging with a cylindrical member 62 formed on a second end of the connecting member 60 and a cylindrical member 81 of an innermost one of a number of leaf plates 80. Each two adjacent leaf plates 80 are connected by a pivotal connecting member 70. In assembly, referring to FIG. 6, a cover 84 is mounted on top of each leaf plate 80 while another cover 74 is mounted on top of each pivotal connecting member 70. In addition, a handle 86 is provided on the outermost leaf plate 80 that is farthest to the fixing member 50. In use, due to provision of a rack 82 provided on top of the doorplate assembly, the whole doorplate assembly may be collapsed to expose an access or extended to a status shown in FIG. 6 to cover the access. Yet, if the overall length of the doorplate assembly in its fully extended status is smaller than a width of the access, a gap 90 is inevitably left. On the other hand, if the overall length of the doorplate assembly in its fully extended status is greater than the width of the access, the doorplate assembly will be partially collapsed. The present invention is intended to provide an improved collapsible doorplate assembly which is adjustable in a length thereof to solve this problem.

SUMMARY OF THE INVENTION

A collapsible doorplate assembly in accordance with the present invention comprises a fixing member adapted to be secured to a wall, a length-adjustable connecting means having a first end securely -connected to the fixing member and a second end, a plurality of pivotal connecting members, and a plurality of leaf plates. Each two adjacent leaf plates are pivotally connected by one of the pivotal connecting members. An innermost one of the pivotal connecting members, which is nearest to the fixing member, is connected between the length-adjustable connecting means and an innermost one of the leaf plates which is nearest to the fixing member. The length-adjustable connecting means includes an engaging member and a movable member. The engaging member includes a first end securely engaged with the fixing member and a second end. The movable member includes a first end slidably engaged with the second end of the engaging member and a second end in pivotal connection with the innermost pivotal connecting member.

In a preferred embodiment of the invention, the second end of the engaging member includes a compartment defined therein and two spaced retainers formed on an end edge thereof to define an access therebetween through which the first end of the movable member is slidably extended. The first end of the movable member is slidably received in the compartment of the engaging member and includes a restraining member formed thereon and received in the compartment. The restraining member has a width greater than that of the access defined in the end edge of the second end of the engaging member to thereby prevent from disengagement of the movable member from the engaging member.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
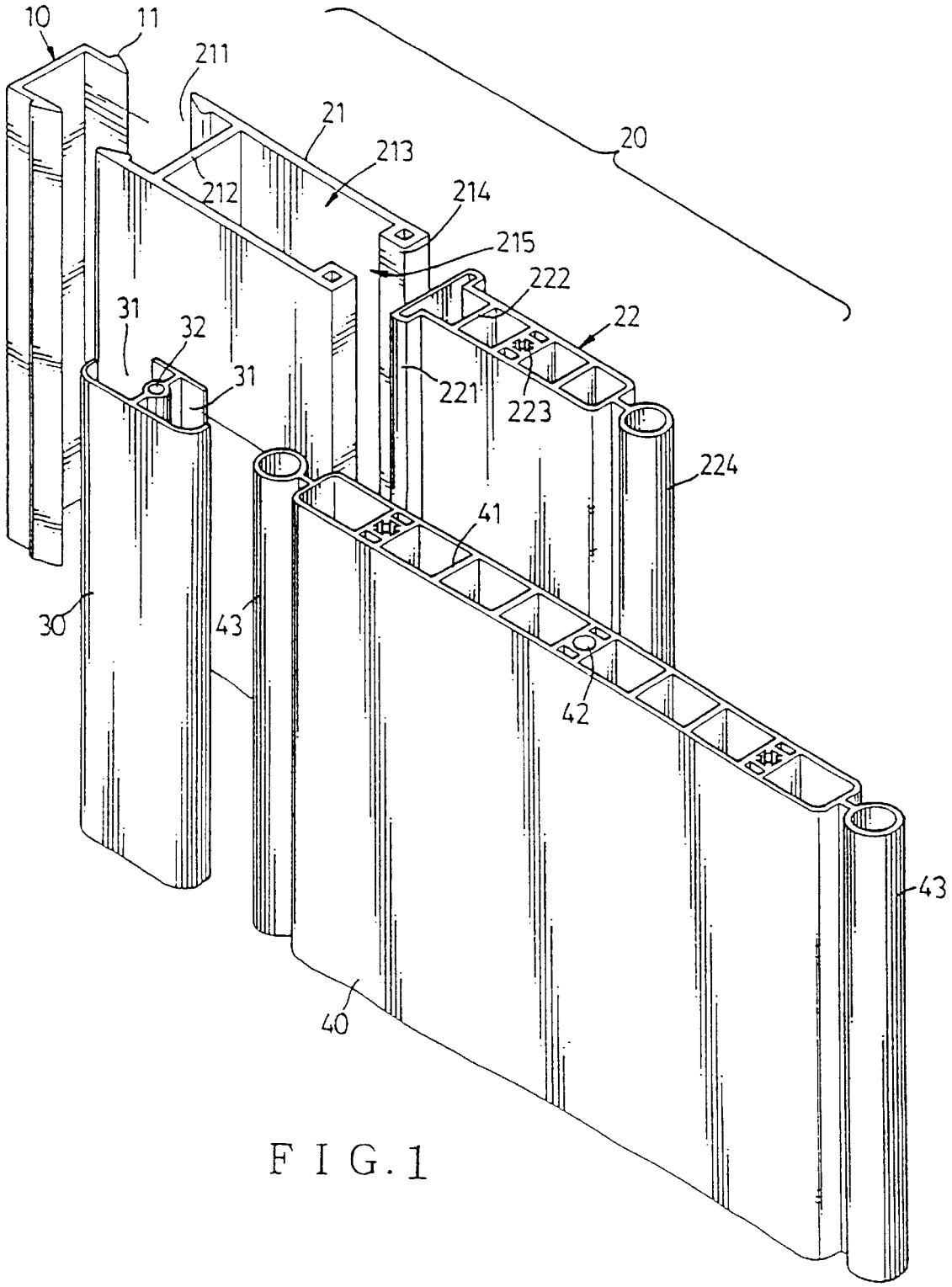
FIG. 1 is an exploded perspective view of a portion of a collapsible doorplate assembly in accordance with the present invention.
Figure 2:
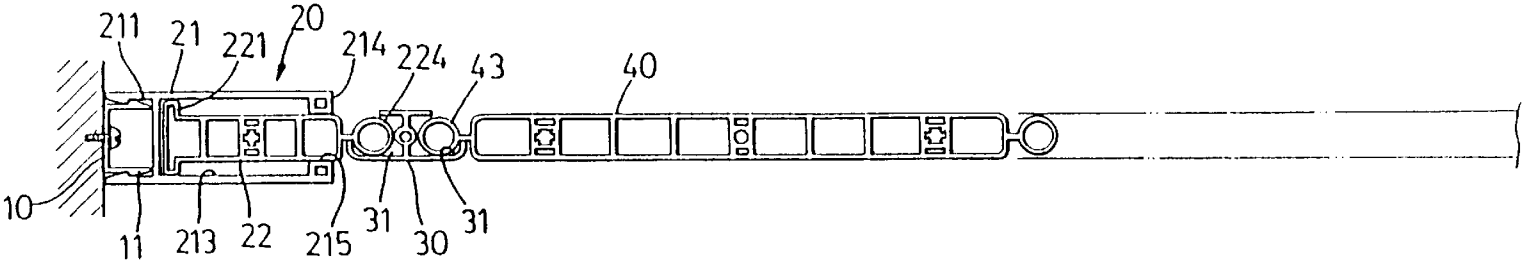
FIG. 2 is a top view of the collapsible doorplate assembly with a top cover removed.
Figure 3:
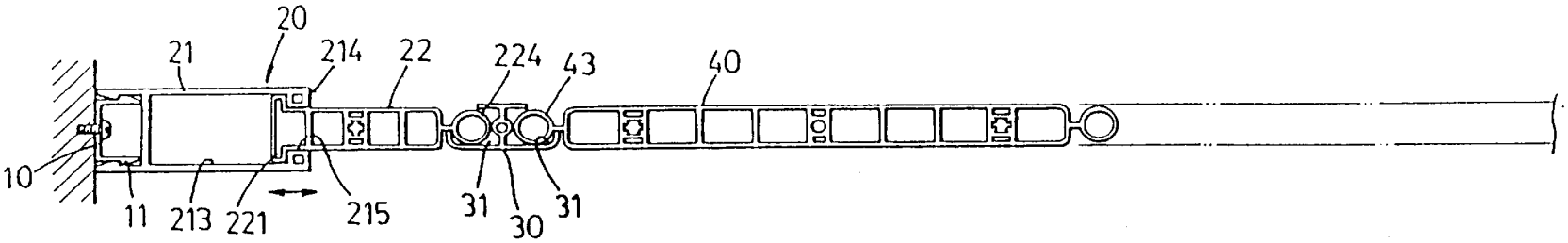
FIG. 3 is a view similar to FIG. 2, illustrating length adjustment of the collapsible doorplate assembly in accordance with the present invention.
Figure 4:
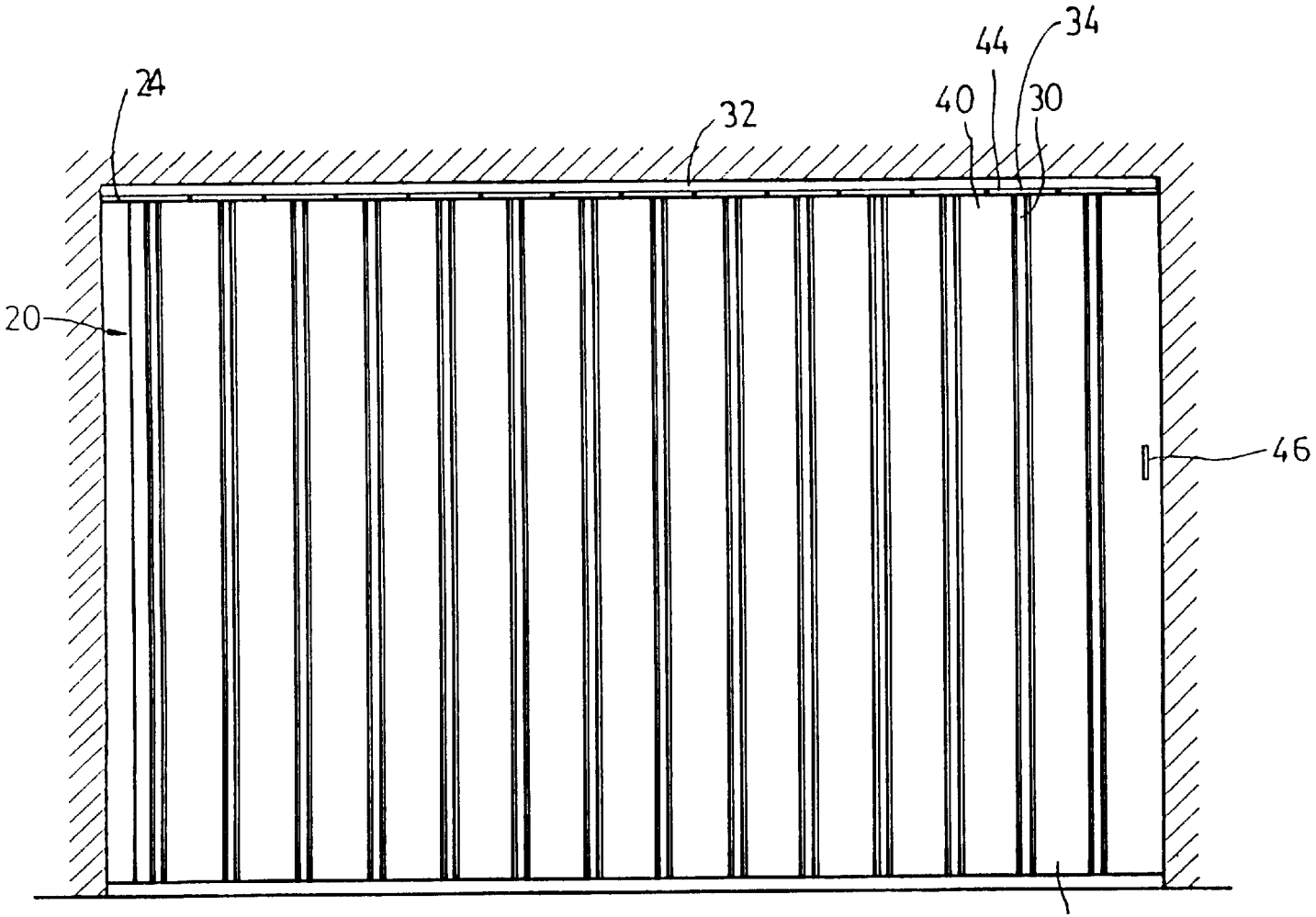
FIG. 4 is a front view illustrating the collapsible doorplate assembly in an extended status.
Figure 5:
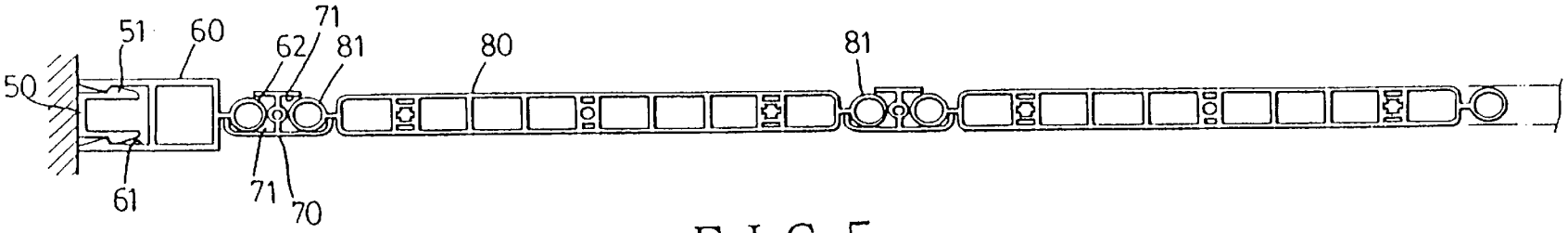
FIG. 5 PRIOR ART
FIG. 5 is a top view illustrating a collapsible doorplate assembly according to prior art.
Figure 6:
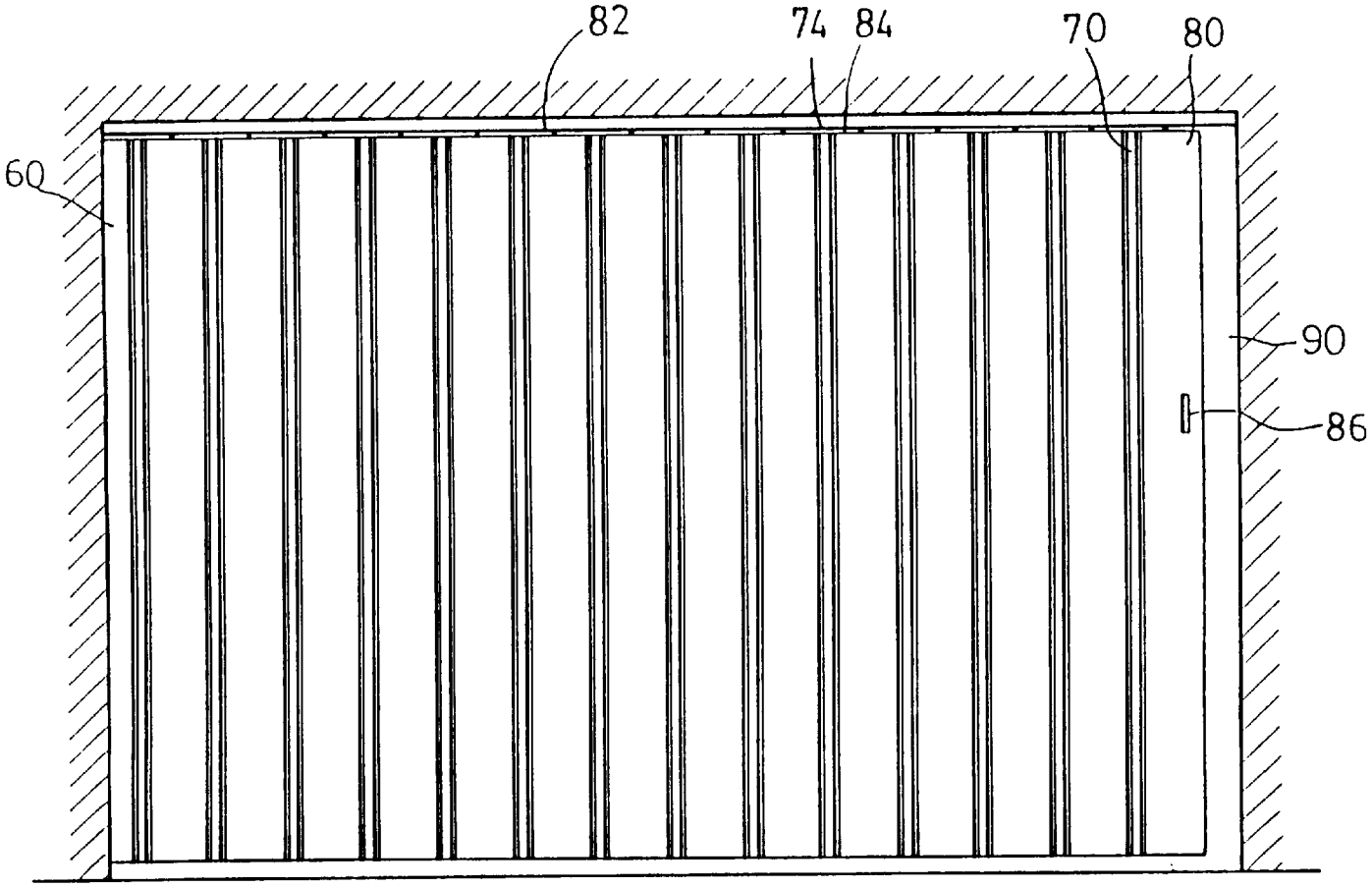
FIG. 6 PRIOR ART
FIG. 6 is a front view illustrating use of the collapsible doorplate assembly in FIG. 5.

Referring to the FIGS. 1 to 4 and initially to FIGS. 1 and 2, a collapsible doorplate assembly in accordance with the present invention generally includes a fixing member 10 secured to a wall (not labeled) by a screw (not labeled, FIG. 2), a length-adjustable connecting means 20, a number of pivotal connecting members 30, and a number of leaf plates 40. The length-adjustable connecting means 20 includes an engaging member 21 and a movable member 22. The engaging member 21 includes a first end 211 engaged with a snapping fastener of the fixing member 10 and a second end having a compartment 213 defined therein. The engaging member 21 may include a reinforcing rib 212 formed in a mediate section thereof In addition, a retainer 214 is formed on an end edge of the second end of the engaging member 21. The movable member 22 includes a first end slidably received in the compartment 213 of the engaging member 21 and a second end 224 which will be described later. The first end of the movable member 22 includes a restraining member 221 formed thereon and received in the compartment 213 and having a width greater than an access 215 defined in the second end of the engaging member 21 to thereby prevent from disengagement of the movable member 22 from the engaging member 21. The movable member 22 may include an engaging section 223 for engaging with a top cover 24 (FIG. 4).

Each pivotal connecting member 30 includes two ends each having a chamber 31 defined therein for pivotal connection. In this embodiment, the second end 224 of the movable member 224 is substantially cylindrical and pivotally received in one of the chamber 31 of the leftmost pivotal connecting member 30 (FIG. 2) which is nearest to the fixing member 10. Each pivotal connecting member 30 may further include an engaging section 32 for engaging with a top cover 34 (FIG. 4).

Each two adjacent leaf plates 40 are connected by one connecting member 30 described above As shown in FIG. 1, each leaf plate 40 includes a cylindrical member 43 formed on each end thereof for pivotal connection with an associated chamber 31 of an associated pivotal connecting member 30. In addition, each leaf plate 40 includes a number of reinforcing ribs 41 and a mediate engaging section 42 for engaging with a top cover 44 (FIG. 4)

In use, referring to FIG. 4, a rack 32 is provided on top of the doorplate assembly such that the user may pull a handle 36 provided on the leaf plate 40 (which is farthest to the fixing member 10) to a collapsed status (not shown) to expose an access (not shown) covered by the doorplate assembly or to a fully extended status (FIG. 4) to cover the access, which is conventional and therefore not further described. It is appreciated that if the overall length of the doorplate assembly is not equal to (e.g., shorter than) a width of the access, the user may pull the movable member 22 away from the engaging member 21 (FIG. 3) to an extent that the overall length of the doorplate assembly may fittingly cover the access without leaving any gap between the wall and the farthest leaf plate 40. If the overall length of the doorplate assembly is greater than the width of the access, the user may push the movable member 22 toward the engaging member 21 to solve this problem.

Although the invention has been explained in relation to its preferred embodiment, it is to be understood that many other possible modifications and variations can be made without departing from the spirit and scope of the invention as hereinafter claimed.

What is claimed is:

1. A collapsible doorplate assembly, comprising: a fixing member adapted to be secured to a wall, a length-adjustable connecting means having a first end securely connected to the fixing member and a second end, a plurality of pivotal connecting members, and a plurality of leaf plates, each two adjacent said leaf plates being pivotally connected by one of said pivotal connecting members, and an innermost one of said pivotal connecting members which is nearest to the fixing member being connected between the length-adjustable connecting means and an innermost one of said leaf plates which is nearest to the fixing member, the length-adjustable connecting means including an engaging member and a movable member, the engaging member including a first end securely engaged with the fixing member and a second end, and the movable member including a first end slidably engaged with the second end of the engaging member and a second end in pivotal connection with the innermost pivotal connecting member.

2. The collapsible doorplate assembly according to claim 1, wherein the second end of the engaging member includes a compartment defined therein and two spaced retainers formed on an end edge thereof to define an access therebetween through which the first end of the movable member is slidably extended, the first end of the movable member is slidably received in the compartment of the engaging member and includes a restraining member formed thereon and received in the compartment and having a width greater than that of the access defined in the end edge of the second end of the engaging member to thereby prevent from disengagement of the movable member from the engaging member.

* * * * *

UNITED STATES PATENT AND TRADEMARK OFFICE

CERTIFICATE OF CORRECTION

PATENT NO. : 5,918,659

DATED : 6 July 1999

INVENTOR(S) : Chen Hsiang Lee

It is certified that error appears in the above-identified patent and that said Letters Patent is hereby corrected as shown below:

On title page, Item [22]

delete the date "Feb. 23, 1998" and insert therefor the date --June 23, 1998--

Signed and Sealed this

Ninth Day of May, 2000

*Attest:*

Q. TODD DICKINSON

*Attesting Officer*

*Director of Patents and Trademarks*